US012247787B2

(12) United States Patent
Nakata et al.

(10) Patent No.: US 12,247,787 B2
(45) Date of Patent: Mar. 11, 2025

(54) HEAT EXCHANGER

(71) Applicant: FUJITSU GENERAL LIMITED, Kanagawa (JP)

(72) Inventors: Shohei Nakata, Kanagawa (JP); Yoshinari Maema, Kanagawa (JP); Kotaro Oka, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 293 days.

(21) Appl. No.: 17/909,198

(22) PCT Filed: Mar. 5, 2021

(86) PCT No.: PCT/JP2021/008827
§ 371 (c)(1),
(2) Date: Sep. 2, 2022

(87) PCT Pub. No.: WO2021/192937
PCT Pub. Date: Sep. 30, 2021

(65) Prior Publication Data

US 2023/0085871 A1 Mar. 23, 2023

(30) Foreign Application Priority Data

Mar. 24, 2020 (JP) ..... 2020-053157

(51) Int. Cl.
*F28F 9/02* (2006.01)
*F25B 39/02* (2006.01)
(Continued)

(52) U.S. Cl.
CPC ..... *F28D 1/053* (2013.01); *F25B 39/02* (2013.01); *F28F 1/02* (2013.01); *F28F 9/0204* (2013.01);
(Continued)

(58) Field of Classification Search
CPC ..... F28F 9/0204; F28F 9/0214; F25B 39/028
See application file for complete search history.

(56) References Cited

U.S. PATENT DOCUMENTS

2013/0126140 A1 5/2013 Park et al.
2016/0238322 A1 8/2016 Inoue et al.
(Continued)

FOREIGN PATENT DOCUMENTS

CN 105593628 A 5/2016
CN 106871700 A 6/2017
(Continued)

OTHER PUBLICATIONS

Feb. 27, 2024, European Search Report issued for related EP Application No. 21775647.7.
(Continued)

*Primary Examiner* — Eric S Ruppert
(74) *Attorney, Agent, or Firm* — Paratus Law Group, PLLC

(57) ABSTRACT

A heat exchanger includes flat heat transfer tubes and a header, wherein the header includes a first partition member that separates an internal space of a main body unit into a refrigerant inflow portion and an upper portion, a second partition member that separates the upper portion into a connected portion connected to the flat heat transfer tubes and an opposite portion, and a third partition member that separates the opposite portion into a windward portion and a leeward portion a plurality of windward communication holes allowing communication between the windward portion and the connected portion and a plurality of leeward communication holes allowing communication between the leeward portion and the connected portion are arranged in the second partition member an adjustment channel that increases a flow rate of the windward communication holes
(Continued)

as compared to a flow rate of the leeward communication holes is arranged inside the header.

8 Claims, 10 Drawing Sheets

(51) Int. Cl.
*F28D 1/053* (2006.01)
*F28F 1/02* (2006.01)
*F28F 9/22* (2006.01)

(52) U.S. Cl.
CPC ..... *F28F 9/0278* (2013.01); *F28F 9/22* (2013.01); *F25B 39/028* (2013.01)

(56) References Cited

U.S. PATENT DOCUMENTS

| | | | | |
|---|---|---|---|---|
| 2018/0073819 | A1* | 3/2018 | Kim | F28F 9/028 |
| 2018/0347916 | A1 | 12/2018 | Jin et al. | |
| 2022/0316804 | A1* | 10/2022 | Onaka | F25B 39/00 |

FOREIGN PATENT DOCUMENTS

| | | | |
|---|---|---|---|
| EP | 3088832 | A1 | 11/2016 |
| EP | 3425320 | A1 | 1/2019 |
| EP | 3473963 | A1 | 4/2019 |
| EP | 3647711 | A1 | 5/2020 |
| EP | 4130638 | A1 | 2/2023 |
| JP | 2001-215096 | A | 8/2001 |
| JP | 2014-037899 | A | 2/2014 |
| JP | 2014-137177 | A | 7/2014 |
| JP | 2014-533819 | A | 12/2014 |
| JP | 2015-068622 | A | 4/2015 |
| JP | 2016-125748 | A | 7/2016 |
| JP | 2017-155992 | A | 9/2017 |
| JP | 2017-211113 | A | 11/2017 |
| JP | 2018-100800 | A | 6/2018 |
| JP | 2018-536835 | A | 12/2018 |
| JP | 2019-027727 | A | 2/2019 |
| JP | 6664558 | B1 | 3/2020 |

OTHER PUBLICATIONS

Oct. 1, 2024, Chinese Office Action issued for related CN Application No. 202180020880.7.

* cited by examiner

HEAT EXCHANGER

CROSS REFERENCE TO PRIOR APPLICATION

This application is a National Stage Patent Application of PCT International Patent Application No. PCT/JP2021/008827 (filed on Mar. 5, 2021) under 35 U.S.C. § 371, which claims priority to Japanese Patent Application No. 2020-053157 (filed on Mar. 24, 2020), which are all hereby incorporated by reference in their entirety.

FIELD

The disclosed technology relates to a heat exchanger.

BACKGROUND

Conventionally, a heat exchanger that is configured such that both ends of a flat heat transfer tube including a plurality of channels are inserted in and connected to headers on left and right sides and a refrigerant is distributed from one of the headers to the flat heat transfer tube is known (for example, see Patent Literatures 1 to 3).

In an air conditioner using a heat exchanger of the above-described type, when heat exchange is performed between a refrigerant and external air, a heat exchange amount in a channel that is located on a windward side in the flat heat transfer tube is relatively large. Therefore, a technology for distributing a larger amount of refrigerant to a channel that is located on the windward side as compared to a channel that is located on a leeward side in the same flat heat transfer tube has been proposed. For example, a technology for providing a partition member that separates an internal space of a header into a connected portion that is connected to a flat heat transfer tube and an opposite portion that is located opposite to the connected portion across the flat heat transfer tube, and arranging a hole in the partition member has been proposed (see Patent Literature 1). The hole is arranged at a position at which a large amount of refrigerant flows into a channel that is located on an upstream side in an air flow direction.

CITATION LIST

Patent Literature

Patent Literature 1: Japanese Laid-open Patent Publication No. 2014-37899

Patent Literature 2: Japanese Translation of PCT International Application Publication No. 2014-533819

Patent Literature 3: Japanese Laid-open Patent Publication No. 2019-27727

SUMMARY

Technical Problem

In the header of the above-described type, even when the hole is formed in the partition member at a position at which a large amount of refrigerant flows into the channel that is located on the upstream side in the air flow direction, if the refrigerant is distributed while the heat exchanger is inclined to a downstream side in the air flow direction, a large amount of refrigerant flows to the downstream side. This is because, due to an influence of gravity, a larger amount of refrigerant in a liquid state is distributed to a lower position in a height direction in the internal space of the header. In other words, depending on the way of mounting the heat exchanger or the way of installing the air conditioner, a rate of a refrigerant to be distributed to the upstream side in the air flow direction deviates from an intended rate.

The disclosed technology has been conceived in view of the foregoing situation, and an object of the disclosed technology is to obtain a heat exchanger that prevents a rate of a refrigerant to be distributed to a channel that is located on an upstream side in an air flow direction from deviating from an intended rate.

Solution to Problem

According to an aspect of an embodiment, a heat exchanger includes a plurality of flat heat transfer tubes that are laminated such that wide surfaces face one another, and a header that are connected to end portions of the plurality of flat heat transfer tubes, and that distributes a refrigerant to the plurality of flat heat transfer tubes, wherein the header includes a tubular main body unit, a first partition member that separates an internal space of the main body unit into a refrigerant inflow portion into which the refrigerant flows and an upper portion that is located above the refrigerant inflow portion, a second partition member that separates the upper portion into a connected portion that is connected to the plurality of flat heat transfer tubes and an opposite portion that is located opposite to the flat heat transfer tubes across the connected portion, and a third partition member that separates the opposite portion into a windward portion and a leeward portion that is located on a leeward side of an external air flow with respect to the windward portion, a plurality of windward communication holes and a plurality of leeward communication holes are arranged in the second partition member, the plurality of windward communication holes being aligned in a lamination direction of the plurality of flat heat transfer tubes and allowing communication between the windward portion and the connected portion, the plurality of leeward communication holes being aligned in the lamination direction of the plurality of flat heat transfer tubes and allowing communication between the leeward portion and the connected portion, and an adjustment channel is arranged inside the header, the adjustment channel allowing the refrigerant that has flown into the refrigerant inflow portion to be distributed to the windward portion and the leeward portion, and increasing a flow rate of the plurality of windward communication holes as compared to a flow rate of the plurality of leeward communication holes.

Advantageous Effects of Invention

The disclosed heat exchanger realizes a heat exchanger that prevents a rate of a refrigerant to be distributed to a channel that is located on an upstream side in an air flow direction from deviating from an intended rate.

DESCRIPTION OF EMBODIMENTS

Embodiments will be described below with reference to the accompanying drawings. Meanwhile, the same components are denoted by the same reference symbols throughout the descriptions of the embodiments.

First Embodiment

Air Conditioner

Figure 1:
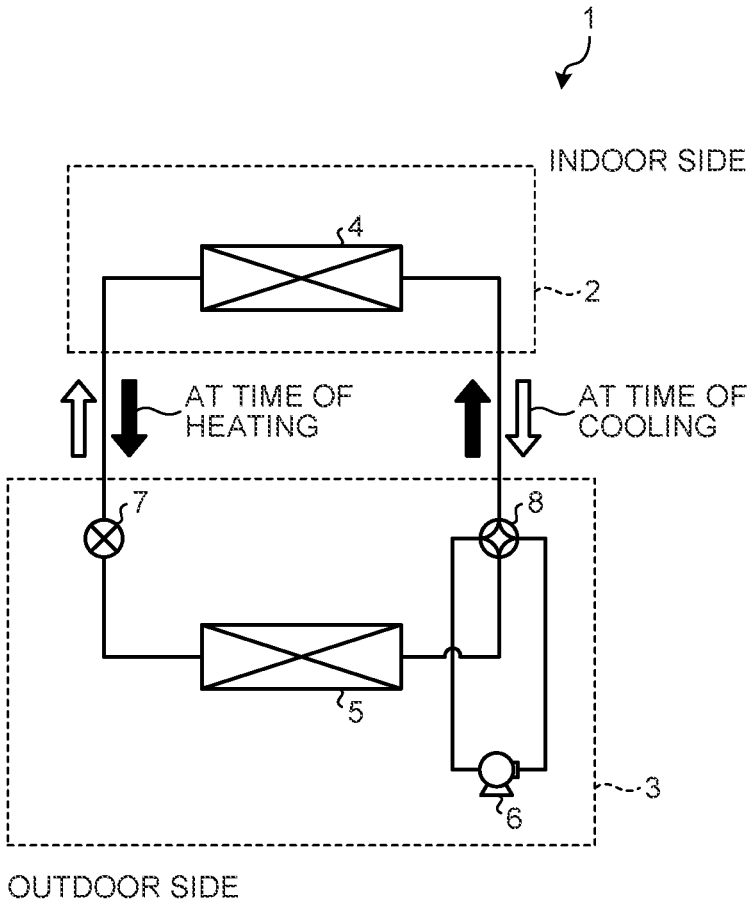
FIG. 1 is a diagram for explaining a configuration of an air condition to which heat exchangers according to a first embodiment are applied.

FIG. 1 is a diagram for explaining a configuration of an air conditioner 1 to which a heat exchanger 4 and a heat exchanger 5 according to a first embodiment are applied. As illustrated in FIG. 1, the air conditioner 1 includes an indoor unit 2 and an outdoor unit 3. The heat exchanger 4 for indoor use is arranged in the indoor unit 2, and the heat exchanger 5 for outdoor use, a compressor 6, an expansion valve 7, and a four way valve 8 are arranged in the outdoor unit 3.

At the time of heating operation, a high temperature high pressure gas refrigerant that is discharged from the compressor 6 of the outdoor unit 3 flows into the heat exchanger 4, which functions as a condenser, via the four way valve 8. At the time of heating operation, the refrigerant flows in a direction indicated by black arrows in FIG. 1. In the heat exchanger 4, the refrigerant that has been subjected to heat exchange with external air is liquefied. The liquefied high pressure refrigerant is depressurized by passing through the expansion valve 7, and flows, as a low temperature low pressure gas liquid two phase refrigerant, into the heat exchanger 5 that functions as an evaporator. In the heat exchanger 5, the refrigerant that has been subjected to heat exchange with external air is gasified. The gasified low pressure refrigerant is sucked by the compressor 6 via the four way valve 8.

At the time of cooling operation, a high temperature high pressure gas refrigerant that is discharged from the compressor 6 of the outdoor unit 3 flows into the heat exchanger 5, which functions as a condenser, via the four way valve 8. At the time of cooling operation, the refrigerant flows in a direction indicated by white arrows in FIG. 1. In the heat exchanger 5, the refrigerant that has been subjected to heat exchange with external air is liquefied. The liquefied high pressure refrigerant is depressurized by passing through the expansion valve 7, and flows, as a low temperature low pressure gas liquid two phase refrigerant, into the heat exchanger 4 that functions as an evaporator. In the heat exchanger 4, the refrigerant that has been subjected to heat exchange with external air is gasified. The gasified low pressure refrigerant is sucked by the compressor 6 via the four way valve 6.

Heat Exchanger

Figure 2A:
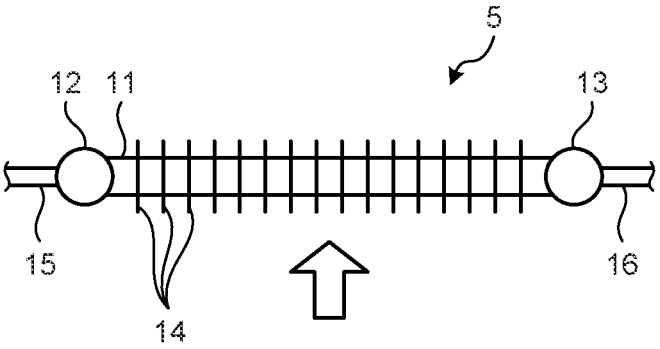
FIG. 2A is a plan view of the heat exchanger according to the first embodiment.
Figure 2B:
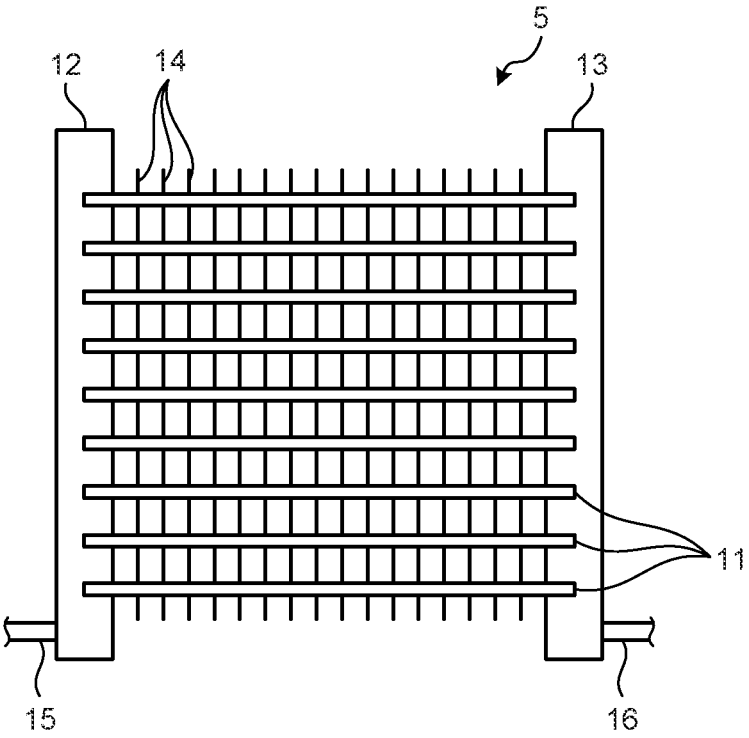
FIG. 2B is a front view of the heat exchanger according to the first embodiment.

The heat exchanger according to the first embodiment is applicable to both of the heat exchanger 4 and the heat exchanger 5, but explanation will be given based on the assumption that the heat exchanger is adopted as the heat exchanger 5 that functions as an evaporator at the time of heating operation FIG. 2A and FIG. 2B are diagrams for explaining the heat exchanger 5 according to the first embodiment. FIG. 2A is a plan view of the heat exchanger 5, and FIG. 2B is a front view of the heat exchanger 5.

The heat exchanger 5 includes a plurality of flat heat transfer tubes 11 which are laminated such that wide surfaces face one another and in which a refrigerant is distributed, a tubular header 12 to which one ends of the plurality of flat heat transfer tubes 11 are connected and which distributes the refrigerant to the flat heat transfer tubes 11, a tubular header 13 to which other ends of the plurality of flat heat transfer tubes 11 are connected and in which the refrigerants discharged from the flat heat transfer tubes 11 flow together, and a plurality of flat plate shaped fins 14 that are bonded to the flat heat transfer tubes 11. The flat heat transfer tubes 11 extend in a direction perpendicular to a direction in which external air is distributed as indicated by an arrow in FIG. 2A, and have flat shaped cross sections. Here, the external air is distributed by air blowing performed by a fan (not illustrated). The flat heat transfer tubes 11 include, inside thereof, a plurality of channels that extend in the same direction as a direction in which the flat heat transfer tubes 11 extend. The plurality of channels are aligned in a width direction of the flat heat transfer tubes 11 (in the direction in which the external air is distributed). As illustrated in FIG. 2B, the flat heat transfer tubes 11 are laminated in a vertical direction such that flat surfaces (wide surfaces) among side surfaces face one another, and left and right ends are connected to the header 12 and the header 13. Furthermore, the plurality of fins 14 are arranged so as to be perpendicular to the flat heat transfer tubes 11 between the header 12 and the header 13. The low temperature low pressure gas liquid two phase refrigerant that is depressurized by passing through the expansion valve 7 is supplied to the header 12 via a pipe 15, and distributed to each of the flat heat transfer tubes 11. The gas liquid two phase refrigerants that have been subjected to heat exchange with air via the fins 14 when passing through the flat heat transfer tubes 11 are gasified and discharged to the header 13, and the refrigerants that flow together in the header 13 are sucked by the compressor 6 via a pipe 16 and the four way valve 8.

Header

Figure 3:
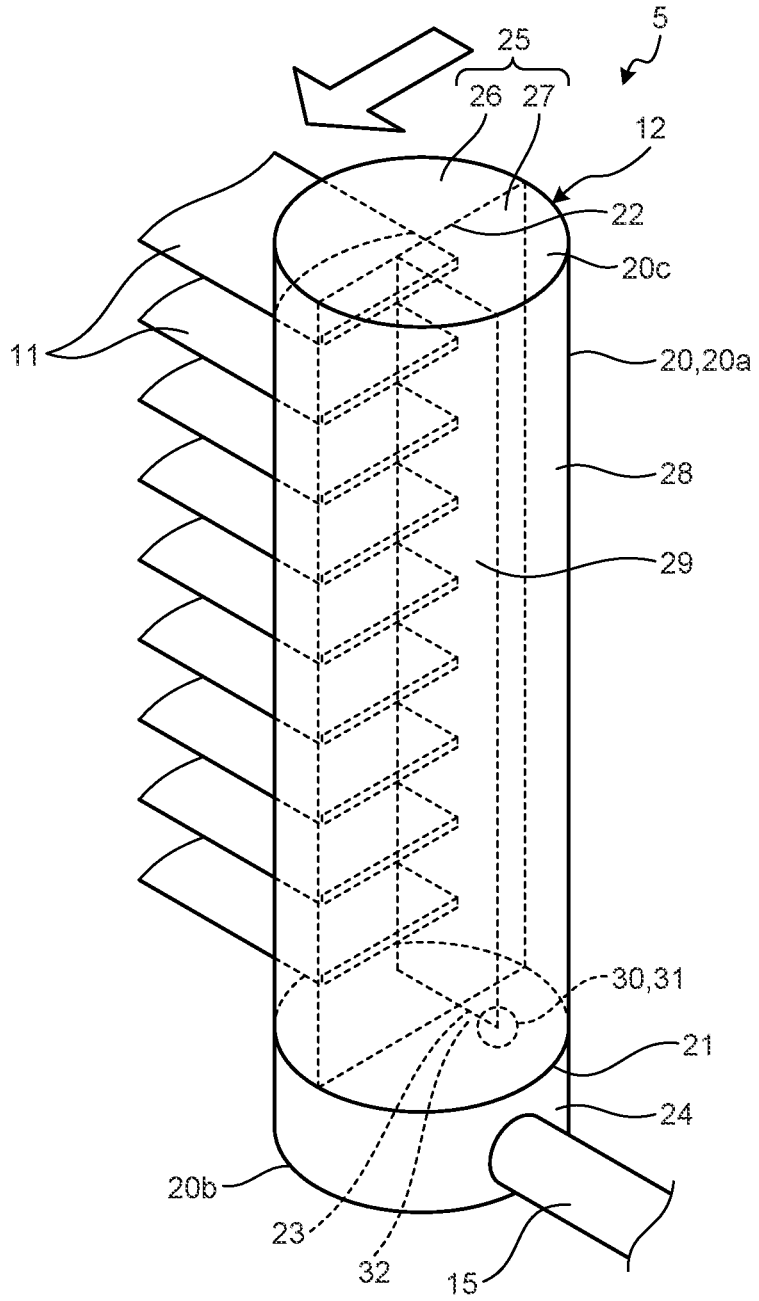
FIG. 3 is a perspective view of a header of the heat exchanger according to the first embodiment.
Figure 9:
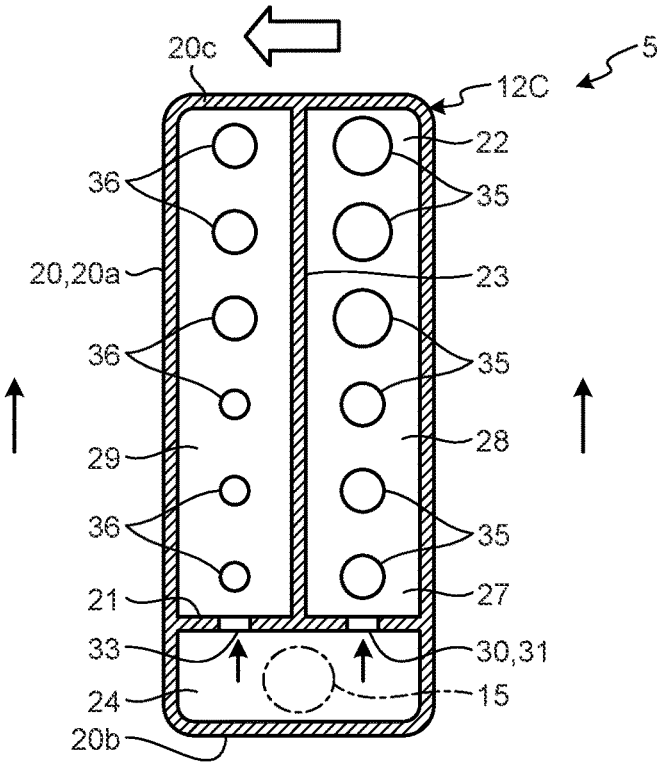
FIG. 9 is a vertical cross sectional view of a header of a heat exchanger according to a fourth embodiment.

The header 12 according to the first embodiment will be described below with reference to FIG. 3 to FIG. 5. Meanwhile, in the present specification, one side of the header 12 at the side of the flat heat transfer tubes 11 will be referred to as an inner side, and the other side of the header 12 opposite to the flat heat transfer tubes 11 will be referred to as an outer side. Further, the heat exchanger 5 is arranged such that a length direction of the flat heat transfer tubes 11, that is, a direction parallel to the flat surfaces of the flat heat transfer tubes 11, extends along a horizontal direction. Furthermore, the heat exchanger 5 is arranged such that a lamination direction of the flat heat transfer tubes 11, that is, a direction perpendicular to the flat surfaces of the flat heat transfer tubes 11, extends along a vertical direction (top bottom direction). Meanwhile, an air blowing fan (not illustrated) is arranged in the vicinity of the heat exchanger 5, and the air blowing fan supplies external air to the heat exchanger 5. FIG. 3 is a perspective view of the header 12 of the heat exchanger 5 according to the first embodiment. FIG. 9 is a horizontal cross sectional view of the header 12 in FIG. 3. FIG. 5 is a vertical cross sectional view of the header 12 in FIG. 3. In FIG. 3, illustration of the fins 14 is omitted.

Figure 4:
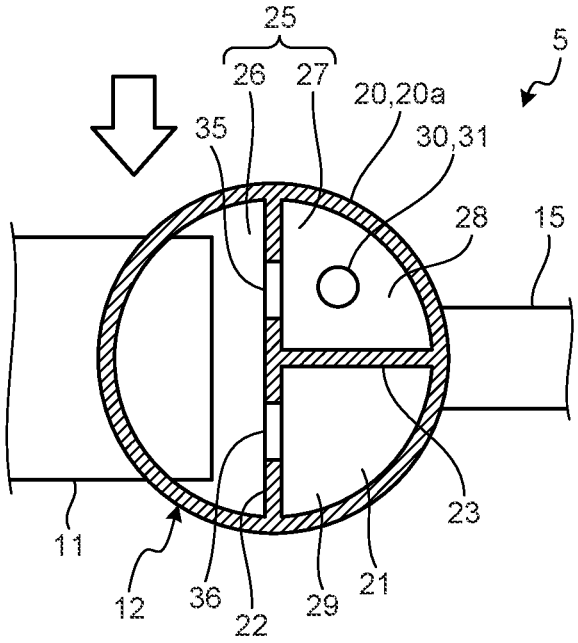
FIG. 4 is a horizontal cross sectional view of the header in FIG. 3.
Figure 5:
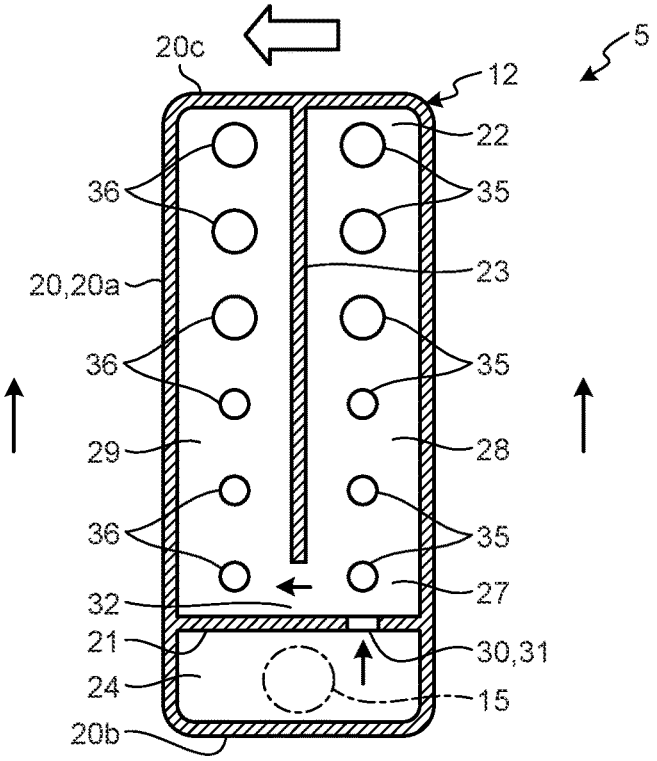
FIG. 5 is a vertical cross sectional view of the header in FIG. 3.

As illustrated in FIG. 3 to FIG. 5, the header 12 includes a main body unit 20 that has a tubular shape, a first partition member 21 that is arranged inside the main body unit 20, a second partition member 22 that is arranged inside the main body unit 20, and a third partition member 23 that is arranged inside the main body unit 20.

The main body unit 20 includes a cylindrical portion 20*a* that has a cylindrical shape and that extends in the vertical direction, a lower wall 20*b* that closes a lower end opening of the cylindrical portion 20*a*, and an upper wall 20*c* that closes an upper end opening of the cylindrical portion 20*a*. In other words, the main body unit 20 has a hollow shape. As illustrated in FIG. 3 and FIG. 4, the header 12 having the cylindrical shape is used, but the header 12 need not always be formed in the cylindrical shape, but may be formed in a hollow rectangular columnar shape or the like.

The first partition member 21 is formed in a disk shape that extends in the horizontal direction, and separates an internal space of the main body unit 20 into a refrigerant inflow portion 24 and an upper portion 25 that is located above the refrigerant inflow portion 24. The first partition member 21 is arranged all over the cylindrical portion 20*a* in the horizontal direction. The low temperature low pressure gas liquid two phase refrigerant flows into the refrigerant inflow portion 24 from the expansion valve 7 through the pipe 15.

The second partition member 22 is arranged in the upper portion 25, and formed in a rectangular plate shape that extends in the vertical direction. The second partition member 22 separates the upper portion 25 into a connected portion 26 that is connected to the plurality of flat heat transfer tubes 11 and an opposite portion 27 that is not connected to the plurality of flat heat transfer tubes 11 and that is located on an opposite side of the plurality of flat heat transfer tubes 11 across the connected portion 26. The second partition member 22 is arranged all over the upper portion 25 in the vertical direction.

The third partition member 23 is arranged in the opposite portion 27, is formed in a rectangular plate shape that extends in the vertical direction, and separates the opposite portion 27 into one end side and another end side of an external air flow. Meanwhile, the heat exchanger 5 is arranged such that the one end side serves as an upstream side (windward side) of external air, and the other end side serves as a downstream side (leeward side) of the external air. Specifically, the third partition member 23 separates the opposite portion into a windward portion 28 (one end side) and a leeward portion 29 (other end side) that is located on the leeward side of an external air flow with respect to the windward portion 28. An upper end portion of the third partition member 23 is connected to the upper wall 20*c*. A lower end portion of the third partition member 23 is separated from the first partition member 21. Therefore, a communication path 32 is arranged between the lower end portion of the third partition member 23 and the first partition member 21. In other words, the communication path 32 is arranged in the lower end portion of the third partition member 23. The lower end portion of the third partition member 23 is one example of an end portion of the third partition member 23 in the vertical direction.

A plurality of windward communication holes 35 and a plurality of leeward communication holes 36 are arranged in the second partition member 22. The plurality of windward communication holes 35 penetrate through the second partition member 22. The plurality of windward communication holes 35 are aligned in the vertical direction and allow communication between the windward portion 28 and the connected portion 26. The plurality of leeward communication holes 36 penetrate through the second partition member 22. The plurality of leeward communication holes 36 are aligned in the vertical direction and allow communication between the leeward portion 29 and the connected portion 26. The number of the windward communication holes 35 and the number of the leeward communication holes 36 are smaller than the number of the plurality of flat heat transfer tubes 11 that are connected to the connected portion 26. The plurality of windward communication holes 35 and the plurality of leeward communication holes 36 have different cross sectional areas depending on positions in the vertical direction. For example, opening areas (hole diameters) of a predetermined number of the windward communication holes 35 located on an upper side among all of the windward communication holes 35 are larger than opening areas (hole diameters) of the windward communication holes 35 that are located below the predetermined number of the windward communication holes 35. Further, opening areas (hole diameters) of a predetermined number of the leeward communication holes 36 located on an upper side among all of the leeward communication holes 36 are larger than opening areas (hole diameters) of the leeward communication holes 36 that are located below the predetermined number of the leeward communication holes 36.

Furthermore, a windward inflow path 31 that is arranged in the first partition member 21, the communication path 32 that is arranged in the lower end portion of the third partition member 23, the plurality of windward communication holes 35, and the plurality of leeward communication holes 36 are arranged inside the header 12. The windward inflow path 31 allows communication between the refrigerant inflow portion 24 and the windward portion 28. The windward inflow path 31 is formed of a penetration hole that penetrates through the first partition member 21 in the vertical direction. The windward inflow path 31 allows the refrigerant to flow from the refrigerant inflow portion 24. The communication path 32 may be referred to as a bypass path.

Further, an adjustment channel 30 is arranged inside the header 12. The adjustment channel 30 includes the windward inflow path 31 and the communication path 32. The adjustment channel 30 allows the refrigerant that has flown into the refrigerant inflow portion 24 to be distributed to the windward portion 28 and the leeward portion 29, and increases a flow rate of the plurality of windward communication holes 35 as compared to a flow rate of the plurality of leeward communication holes 36.

In the header 12 configured as described above, the refrigerant that has flown into the refrigerant inflow portion 24 flows to the opposite portion 27 through the windward inflow path 31. A part of the refrigerant that has flown into the opposite portion 27 flows upward in the windward portion 28, flows into the connected portion 26 via the plurality of windward communication holes 35, and flows into channels on the windward side of the flat heat transfer tubes 11. In contrast, the rest of the refrigerant that has flown into the opposite portion 27 flows into the leeward portion 29 through the communication path 32. The refrigerant that has flown into the leeward portion 29 flows upward in the leeward portion 29, flows into the connected portion 26 via the plurality of leeward communication holes 36, and flows into channels on the leeward side of the flat heat transfer tubes 11.

As described above, in the first embodiment, the heat exchanger 5 includes the plurality of flat heat transfer tubes 11 and the header 12. The plurality of flat heat transfer tubes 11 extend in the horizontal direction, arranged at intervals in the vertical direction, and allow distribution of a refrigerant. The header 12 is connected to one ends of the plurality of flat heat transfer tubes 11, and distributes the refrigerant to the plurality of flat heat transfer tubes 11. Further, the header 12 includes the tubular main body unit 20, the first partition member 21, the second partition member 22, and the third partition member 23. The first partition member 21 separates the internal space of the main body unit 20 into the refrigerant inflow portion 24 to which the refrigerant flows, and the upper portion 25 that is located above the refrigerant inflow portion 24. The second partition member 22 separates the upper portion 25 into the connected portion 26 that is connected to the plurality of flat heat transfer tubes 11, and the opposite portion 27 that is located on the opposite side of the plurality of flat heat transfer tubes 11 across the connected portion 26. The third partition member 23 separates the opposite portion 27 into the windward portion 28 and the leeward portion 29 that is located on the leeward side of an external air flow with respect to the windward portion 28. In the second partition member 22, the plurality of windward communication holes 35 that are aligned in the vertical direction and allow communication between the windward portion 28 and the connected portion 26, and the plurality of leeward communication holes 36 that are aligned in the vertical direction and allow communication between the leeward portion 29 and the connected portion 26 are arranged. In the header 12, the adjustment channel 30 is arranged that allows the refrigerant that has flown into the refrigerant inflow portion 24 to be distributed to the windward portion 28 and the leeward portion 29, and that increases the flow rate of the plurality of windward communication holes 35 as compared to the flow rate of the plurality of leeward communication holes 36.

With this configuration, the third partition member 23 separates the opposite portion 27 into the windward portion 28 and the leeward portion 29, so that even if the heat exchanger 5 is arranged in an inclined manner, it is possible to prevent the refrigerant that has flown upward in the windward portion 28 from moving to the leeward portion 29 side. Therefore, as compared to a configuration in which the third partition member 23 is not provided, it is possible to prevent a rate of a refrigerant to be distributed to the upstream side in the air flow direction from deviating from an intended rate. Further, with this configuration, the flow rate of the plurality of windward communication holes 35 is increased as compared to the flow rate of the plurality of leeward communication holes 36, so that it is possible to allow a larger amount of refrigerant to flow into channels on the windward side than channels on the leeward side of the plurality of flat heat transfer tubes 11.

Furthermore, in the first embodiment, by adjusting a size of each of the units (the windward inflow path 31 and the communication path 32) of the adjustment channel 30, it is possible to adjust the flow rate of the plurality of windward communication holes 35 and the flow rate of the plurality of leeward communication holes 36.

Moreover, in the first embodiment, the adjustment channel 30 includes the windward inflow path 31 and the communication path 32. The windward inflow path 31 is arranged in the first partition member 21, allows communication between the refrigerant inflow portion 24 and the windward portion 28, and allows the refrigerant to flow from the refrigerant inflow portion 24. The communication path 32 is arranged in the lower end portion of the third partition member 23 in the vertical direction. With this configuration, it is possible to construct the adjustment channel 30 with a relatively simple configuration.

Second Embodiment

Figure 6:
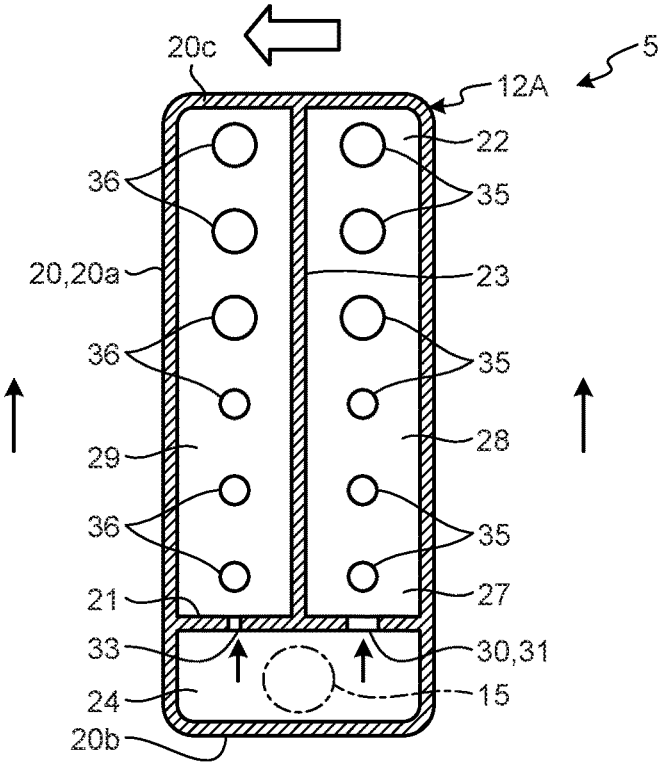
FIG. 6 is a vertical cross sectional view of a header of a heat exchanger according to a second embodiment.
Figure 7:
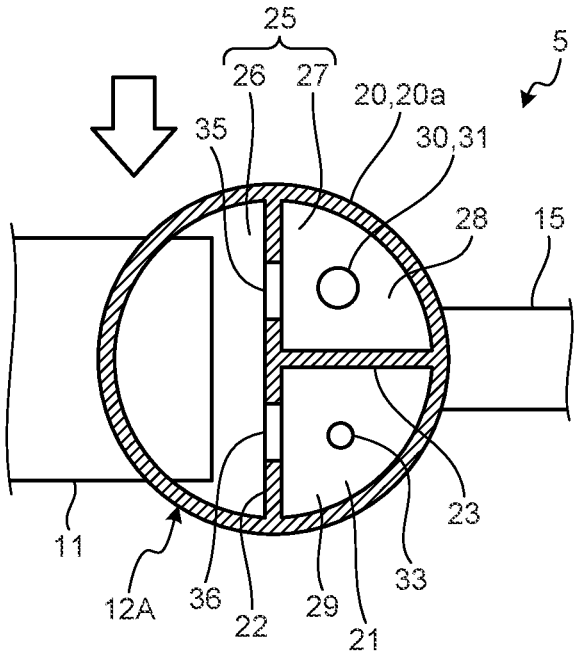
FIG. 7 is a horizontal cross sectional view of the header of the heat exchanger according to the second embodiment.

A header 12A according to a second embodiment will be described below with reference to FIG. 6 and FIG. 7. The heat exchanger 5 is arranged such that the length direction of the flat heat transfer tubes 11, that is, a direction parallel to the flat surfaces of the flat heat transfer tubes 11, extends along the horizontal direction. Further, the heat exchanger 5 is arranged such that the lamination direction of the flat heat transfer tubes 11, that is, a direction perpendicular to the flat surfaces of the flat heat transfer tubes 11, extends along the vertical direction. FIG. 6 is a vertical cross sectional view of the header 12A of the heat exchanger 5 according to the second embodiment. FIG. 7 is a horizontal cross sectional view of the header 12A of the heat exchanger 5 according to the second embodiment.

As illustrated in FIG. 6 and FIG. 7, the header 12A of the second embodiment is different from the header 12 of the first embodiment in that the adjustment channel 30 includes the windward inflow path 31 and a leeward inflow path 33, but does not include the communication path 32.

The windward inflow path 31 is arranged in the first partition member 21, allows communication between the refrigerant inflow portion 24 and the windward portion 28, and allows the refrigerant to flow from the refrigerant inflow portion 24. The refrigerant that has flown into the windward inflow path 31 is discharged to the windward portion 28. The leeward inflow path 33 is arranged in the first partition member 21, allows communication between the refrigerant inflow portion 24 and the leeward portion 29, and allows the refrigerant to flow from the refrigerant inflow portion 24. The refrigerant that has flown into the leeward inflow path 33 is discharged to the leeward portion 29. A cross sectional area of the windward inflow path 31 (an area of a cross section of the windward inflow path 31 in a direction perpendicular to an extending direction of the windward inflow path 31) is larger than a cross sectional area of the leeward inflow path 33 (an area of a cross section of the leeward inflow path 33 in a direction perpendicular to an extending direction of the leeward inflow path 33). Here, a cross sectional area of the windward portion 28 in the horizontal direction may be larger than a cross sectional area of the leeward portion 29 in the horizontal direction, or may be the same as the cross sectional area of the leeward portion 29 in the horizontal direction. The adjustment channel 30 configured as described above allows the refrigerant that has flown into the refrigerant inflow portion 24 to be distributed to the windward portion 28 and the leeward portion 29 through the windward inflow path 31 and the leeward inflow path 33, and increases the flow rate of the plurality of windward communication holes 35 as compared to the flow rate of the plurality of leeward communication holes 36. Meanwhile, if the cross sectional area of the windward portion 28 in the horizontal direction is larger than the cross sectional area of the leeward portion 29 in the horizontal direction, the cross sectional area of the windward inflow path 31 may be the same as the cross sectional area of the leeward inflow path 33.

Here, assuming that the cross sectional area of the windward inflow path 31 is denoted by A, the cross sectional area of the leeward inflow path 33 is denoted by B, a sum of opening areas (total opening area) of the plurality of windward communication holes 35 is denoted by C, and a sum of opening areas (total opening area) of the plurality of leeward communication holes 36 is denoted by D, A to D are set such that at least one of the following relationships is established in the second embodiment.

$$D/C \leq E = A/B \quad (1)$$

Here, E is a positive number and is, for example, 2.3. E is not limited to this example.

$$A/B = C/D \quad (2)$$

In the header 12A configured as described above, a part of the refrigerant that has flown into the refrigerant inflow portion 24 flows into the windward portion 28 of the opposite portion 27 through the windward inflow path 31. The refrigerant that has flown into the windward portion 28 flows upward in the windward portion 28, flows into the connected portion 26 through the plurality of windward communication holes 35, and flows into channels on the windward side of the flat heat transfer tubes 11. In contrast, the other part of the refrigerant that has flown into the refrigerant inflow portion 24 flows into the leeward portion 29 of the opposite portion 27 through the leeward inflow path 33. The refrigerant that has flown into the leeward portion 29 flows upward in the leeward portion 29, flows into the connected portion 26 via the plurality of leeward communication holes 36, and flows into channels on the leeward side of the flat heat transfer tubes 11.

As described above, in the second embodiment, the adjustment channel 30 includes the windward inflow path 31 and the leeward inflow path 33. The windward inflow path 31 is arranged in the first partition member 21, allows communication between the refrigerant inflow portion 24 and the windward portion 28, and allows the refrigerant to flow from the refrigerant inflow portion 24. The leeward inflow path 33 is arranged in the first partition member 21, allows communication between the refrigerant inflow portion 24 and the leeward portion 29, and allows the refrigerant to flow from the refrigerant inflow portion 24. The cross sectional area of the windward inflow path 31 is larger than the cross sectional area of the leeward inflow path 33.

With this configuration, similarly to the first embodiment, the third partition member 23 separates the opposite portion 27 into the windward portion 28 and the leeward portion 29, so that even if the heat exchanger 5 is arranged in an inclined manner, it is possible to prevent the refrigerant that has flown upward in the windward portion 28 from moving to the leeward portion 29 side. Therefore, as compared to a configuration in which the third partition member 23 is not provided, it is possible to prevent a rate of a refrigerant to be distributed to the upstream side in the air flow direction from deviating from an intended rate. Further, with this configuration, the cross sectional area of the windward inflow path 31 is larger than the cross sectional area of the leeward inflow path 33, so that it is possible to increase the flow rate of the windward communication holes 35 as compared to the flow rate of the plurality of leeward communication holes 36 in a relatively simple manner.

Third Embodiment

A header 12B according to a third embodiment will be described below with reference to FIG. 8.

Figure 8:
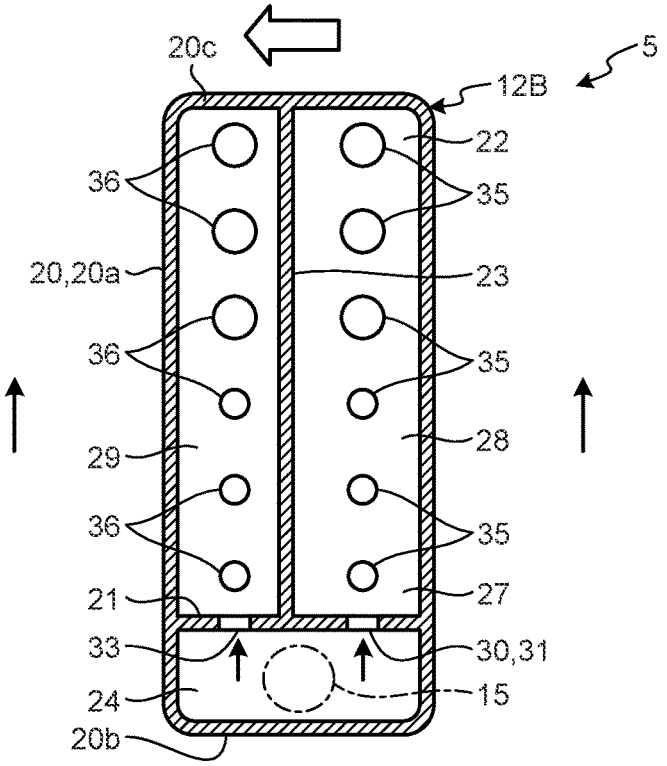
FIG. 8 is a vertical cross sectional view of a header of a heat exchanger according to a third embodiment.

As illustrated in FIG. 8, the header 12B of the third embodiment is different from the header 12A of the second embodiment in that the adjustment channel 30 further includes the windward portion 28 and the leeward portion 29, in addition to the windward inflow path 31 and the leeward inflow path 33. In the third embodiment, the cross sectional area of the windward portion 28 in the horizontal direction is larger than the cross sectional area of the leeward portion 29 in the horizontal direction. Meanwhile, the cross sectional area of the windward inflow path 31 and the cross sectional area of the leeward inflow path 33 are the same.

With this configuration, similarly to the first embodiment, the third partition member 23 separates the opposite portion 27 into the windward portion 28 and the leeward portion 29, so that even if the heat exchanger 5 is arranged in an inclined manner, it is possible to prevent the refrigerant that has flown upward in the windward portion 28 from moving to the leeward portion 29 side. Therefore, as compared to a configuration in which the third partition member 23 is not provided, it is possible to prevent a rate of a refrigerant to be distributed to the upstream side in the air flow direction from deviating from an intended rate. Further, with this configuration, the cross sectional area of the windward portion 28 is larger than the cross sectional area of the leeward portion 29, so that it is possible to increase the flow rate of the windward communication holes 35 as compared to the flow rate of the plurality of leeward communication holes 36 in a relatively simple manner.

Fourth Embodiment

A header 12C according to a fourth embodiment will be described below with reference to FIG. 9.

As illustrated in FIG. 9, the header 12C of the fourth embodiment is different from the header 12A of the second embodiment in that the adjustment channel 30 further includes the plurality of windward communication holes 35 and the plurality of leeward communication holes 36, in addition to the windward inflow path 31 and the leeward inflow path 33. In the fourth embodiment, a sum of areas of cross sections (cross sectional areas) of the plurality of windward communication holes 35 in a direction perpendicular to an extending direction of the windward communication holes 35 is larger than a sum of areas of cross sections (cross sectional areas) of the plurality of leeward communication holes 3 in a direction perpendicular to an extending direction of the leeward communication holes 36. Further, the plurality of windward communication holes 35 and the plurality of leeward communication holes 36 have different cross sectional areas depending on the positions in the vertical direction. For example, the cross sectional areas (hole diameters) of a predetermined number of the windward communication holes 35 located on an upper side among all of the windward communication holes 35 are larger than the cross sectional areas (hole diameters) of the windward communication holes 35 that are located below the predetermined number of the windward communication holes 35. Further, the cross sectional areas (hole diameters) of a predetermined number of the plurality of leeward communication holes 36 located on an upper side among all of the leeward communication holes 36 are larger than the cross sectional areas (hole diameters) of the leeward communication holes 36 that are located below the predetermined number of the leeward communication holes 36. Meanwhile, the cross sectional area of the windward inflow path 31 and the cross sectional area of the leeward inflow path 33 are the same.

With this configuration, similarly to the first embodiment, the third partition member 23 separates the opposite portion 27 into the windward portion 28 and the leeward portion 29, so that even if the heat exchanger 5 is arranged in an inclined manner, it is possible to prevent the refrigerant that has flown upward in the windward portion 28 from moving to the leeward portion 29 side. Therefore, as compared to a configuration in which the third partition member 23 is not provided, it is possible to prevent a rate of a refrigerant to be distributed to the upstream side in the air flow direction from deviating from an intended rate. Further, with this configuration, the total cross sectional area of the plurality of windward communication holes 35 is larger than the total cross sectional area of the plurality of leeward communication holes 36, so that it is possible to increase the flow rate of the windward communication holes 35 as compared to the flow rate of the plurality of leeward communication holes 36 in a relatively simple manner.

Fifth Embodiment

Figure 10:
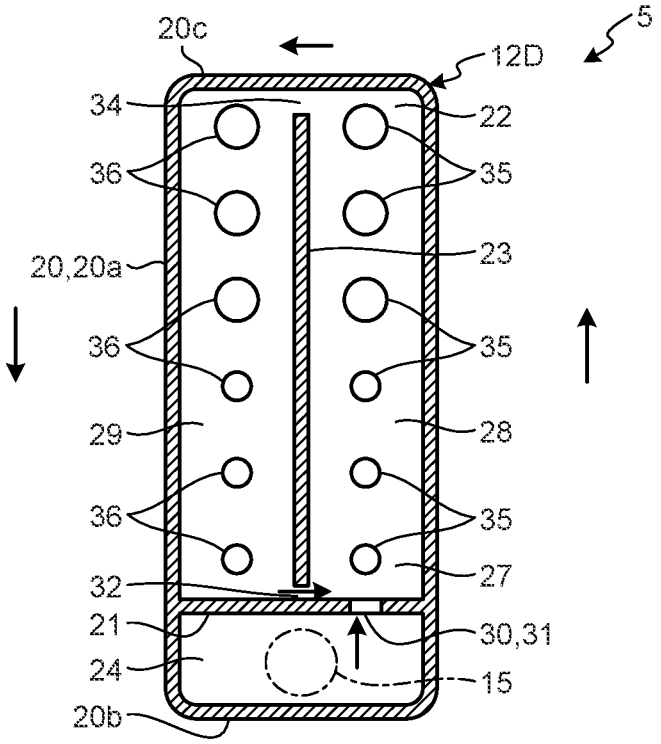
FIG. 10 is a vertical cross sectional view of a header of a heat exchanger according to a fifth embodiment.

FIG. 10 is a vertical cross sectional view of a header 12D of the heat exchanger 5 according to a fifth embodiment.

As illustrated in FIG. 10, the header 12D of the fifth embodiment is different from the header 12 of the first embodiment in that the adjustment channel 30 further includes a communication path 34, in addition to the windward inflow path 31 and the communication path 32.

In the fifth embodiment, the upper end portion of the third partition member 23 is separated from the upper wall 20*c*. Therefore, the communication path 34 is arranged between the upper end portion of the third partition member 23 and the upper wall 20*c*. In other words, the communication path 34 is arranged in the upper end portion of the third partition member 23. The upper end portion of the third partition member 23 is one example of an end portion of the third partition member 23 in the vertical direction. The adjustment channel 30 configured as described above allows the refrigerant that has flown into the refrigerant inflow portion 24 to be distributed to the windward portion 28 and the leeward portion 29 through the windward inflow path 31 and the communication paths 32 and 34, and increases the flow rate of the plurality of windward communication holes 35 as compared to the flow rate of the plurality of leeward communication holes 36.

Further, in the fifth embodiment, the plurality of windward communication holes 35 and the plurality of leeward communication holes 36 are located above the communication path 32. Furthermore, in the fifth embodiment, the plurality of windward communication holes 35 and the plurality of leeward communication holes 36 have the same cross sectional areas. Moreover, the cross sectional area of the windward portion 28 in the horizontal direction is larger than the cross sectional area of the communication path 32.

In the header 12D configured as described above, the refrigerant that has flown into the refrigerant inflow portion 24 flows into the windward portion 28 of the opposite portion 27 through the windward inflow path 31. A part of the refrigerant that has flown into the windward portion 28 flows upward in the windward portion 28, flows into the connected portion 26 via the plurality of windward communication holes 35, and flows into channels on the windward side of the flat heat transfer tubes 11. The other part of the refrigerant that has flown into the windward portion 28 flows into the leeward portion 29 through the communication path 34. A part of the refrigerant that has flown into the leeward portion 29 flows downward on the leeward portion 29, flows into the connected portion 26 via the plurality of leeward communication holes 36, and flows into the leeward portion of the flat heat transfer tubes 11. Furthermore, the other part of the refrigerant that has flown into the leeward portion 29 flows into the windward portion 28 through the communication path 32, and flows upward again in the windward portion 28. In other words, a part of the refrigerant circulates between the windward portion 28 and the leeward portion 29. The windward portion 28 may also be referred to as an outward path or an upward path, and the leeward portion 29 may be referred to as a return path or a downward path.

According to the fifth embodiment configured as described above, the refrigerant circulates between the windward portion 28 and the leeward portion 29, so that it is possible to easily prevent backflow of the refrigerant (downward flow of the refrigerant in the windward portion 28).

Furthermore, in the fifth embodiment, the cross sectional area of the windward portion 28 in the horizontal direction is larger than the cross sectional area of the communication path 32. Therefore, it is possible to easily prevent backflow of the refrigerant (downward flow of the refrigerant in the windward portion 28).

Moreover, in the fifth embodiment, the plurality of windward communication holes 35 and the plurality of leeward communication holes 36 are located above the communication path 32. Furthermore, the communication path 32 is arranged in the lower end portion of the third partition member 23. Therefore, the refrigerant can easily flow back from the leeward portion 29 to the windward portion 28 through the communication path 32, so that it is possible to easily prevent an increase in the amount of the refrigerant that flows from the leeward portion 29 to the connected portion 26.

Sixth Embodiment

Figure 11:
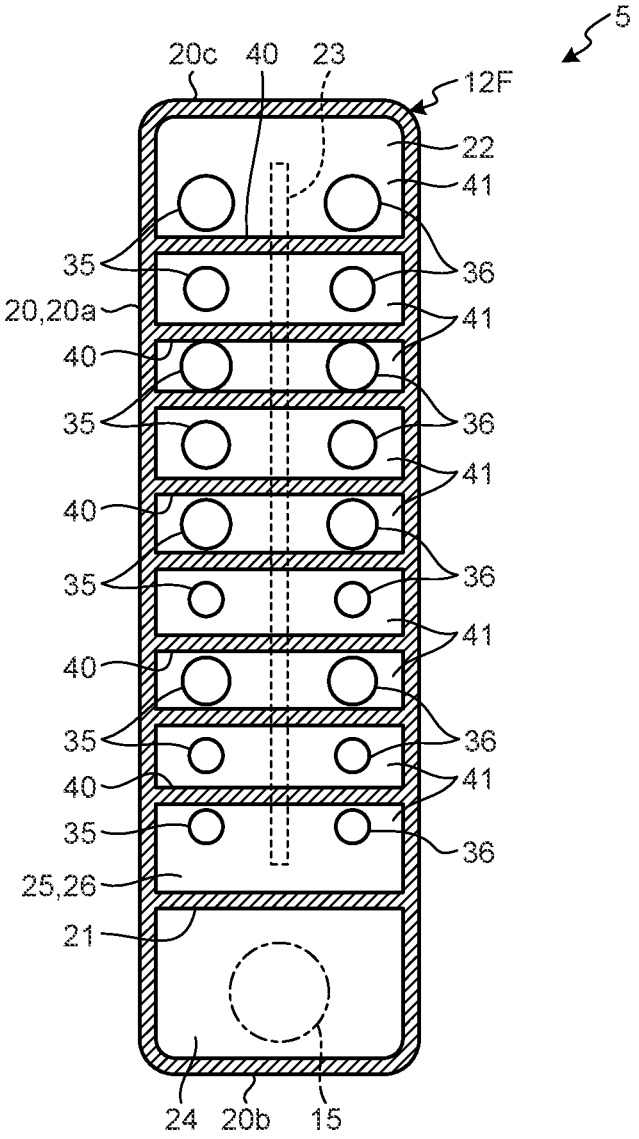
FIG. 11 is a vertical cross sectional view of a header of a heat exchanger according to a sixth embodiment.
Figure 12:
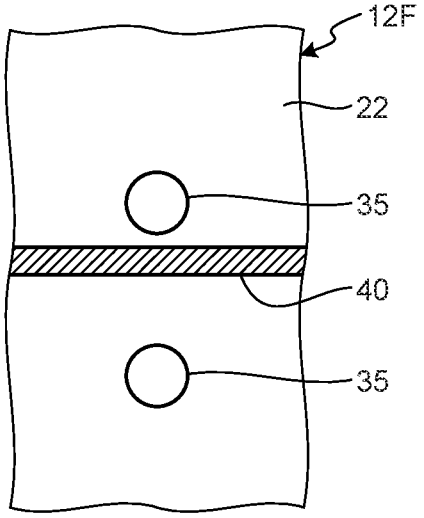
FIG. 12 is a vertical cross sectional view of a part of the header of the heat exchanger according to the sixth embodiment.

FIG. 11 is a vertical cross sectional view of a header 12F of the heat exchanger 5 according to a sixth embodiment. FIG. 12 is a vertical cross sectional view of a part of the header 12F of the heat exchanger 5 according to the sixth embodiment.

As illustrated in FIG. 11, the header 12F of the sixth embodiment is different from the header 12D of the fifth embodiment in that the windward communication holes 35, the leeward communication holes 36, and a plurality of fourth partition members 40 are arranged. The sixth embodiment may be applied to embodiments other than the fifth embodiment.

The windward communication holes 35 and the leeward communication holes 36 are arranged for the respective flat heat transfer tubes 11 that are connected to the connected portion 26. Further, the plurality of windward communication holes 35 and the plurality of leeward communication holes 36 are formed of circular or elliptical holes. At least some of the windward communication holes 35 have different cross sectional areas, and at least some of the leeward communication holes 36 have different cross sectional areas.

The plurality of fourth partition members 40 are arranged in the connected portion 26, formed in plate shapes that extend in the horizontal direction, and separate the connected portion 26 for the respective flat heat transfer tubes 11 that are connected to the connected portion 26. The plurality of fourth partition members 40 separate the connected portion 26 into a plurality of stage portions 41. The plurality of stage portions 41 are laminated in the vertical direction across the plurality of fourth partition members 40.

As illustrated in FIG. 12, as for the windward communication holes 35 that form a pair and that are located above and below a certain one of the fourth partition members 40, the windward communication hole 35 on the upper side is located closer to the fourth partition member 40 as compared to the windward communication hole 35 on the lower side. Further, as for the leeward communication holes 36 that form a pair and that are located above and below a certain one of the fourth partition members 40, the leeward communication hole 36 on the upper side is located closer to the fourth partition member 40 as compared to the leeward communication hole 36 on the lower side. In this case, the fourth partition member 40 is located above an intermediate position between the two flat heat transfer tubes 11 that are located adjacent to each other in the vertical direction.

In the header 12F configured as described above, the refrigerant that has flown into the refrigerant inflow portion 24 flows into the windward portion 28 of the opposite portion 27 through the windward inflow path 31. A part of the refrigerant that has flown into the windward portion 28 flows upward in the windward portion 28, flows into the stage portions 41 of the connected portion 26 via the plurality of windward communication holes 35, and flows into channels on the windward side of the flat heat transfer tubes 11. The other part of the refrigerant that has flown into the windward portion 28 flows into the leeward portion 29 through the communication path 34. A part of the refrigerant that has flown into the leeward portion 29 flows downward on the leeward portion 29, flows into the stage portions 41 of the connected portion 26 via the plurality of leeward communication holes 36, and flows into the leeward portions of the flat heat transfer tubes 11. Furthermore, the other part of the refrigerant that has flown into the leeward portion 29 flows into the windward portion 28 via the communication path 32, and flows upward again in the windward portion 28.

As described above, in the sixth embodiment, the windward communication holes 35 and the leeward communication holes 36 are arranged for the respective flat heat transfer tubes 11 that are connected to the connected portion 26. With this configuration, it is possible to equally distribute the refrigerant to the plurality of flat heat transfer tubes 11.

Furthermore, in the sixth embodiment, the header 12F includes the plurality of fourth partition members 40 that separate the connected portion 26 for the respective flat heat transfer tubes 11 that are connected to the connected portion 26. With this configuration, the refrigerants in the respective stage portions 41 are not mixed together, so that it is possible to more equally distribute the refrigerant to the plurality of flat heat transfer tubes 11.

Moreover, in the sixth embodiment, the third partition member 23 separates the opposite portion 27 into the windward portion 28 and the leeward portion 29, the fourth partition members 40 separate the connected portion 26 into the plurality of stage portions 41, and the windward communication holes 35 and the leeward communication holes 36 are arranged for the respective stage portions 41. Therefore, it is possible to more reliably distribute the refrigerant to the plurality of flat heat transfer tubes 11.

Furthermore, in the present embodiment, each of the fourth partition members 40 is located above the intermediate position between the two flat heat transfer tubes 11 that are located adjacent to each other in the vertical direction. With this configuration, as compared to a case in which each of the fourth partition members 40 is located below the intermediate position between the two flat heat transfer tubes 11 that are located adjacent to each other in the vertical direction, it is possible to reduce a distance from the fourth partition member 40 to a lower portion of the flat heat transfer tube 11 on the upper side, so that it is possible to reduce an amount of the refrigerant.

Seventh Embodiment

Figure 13:
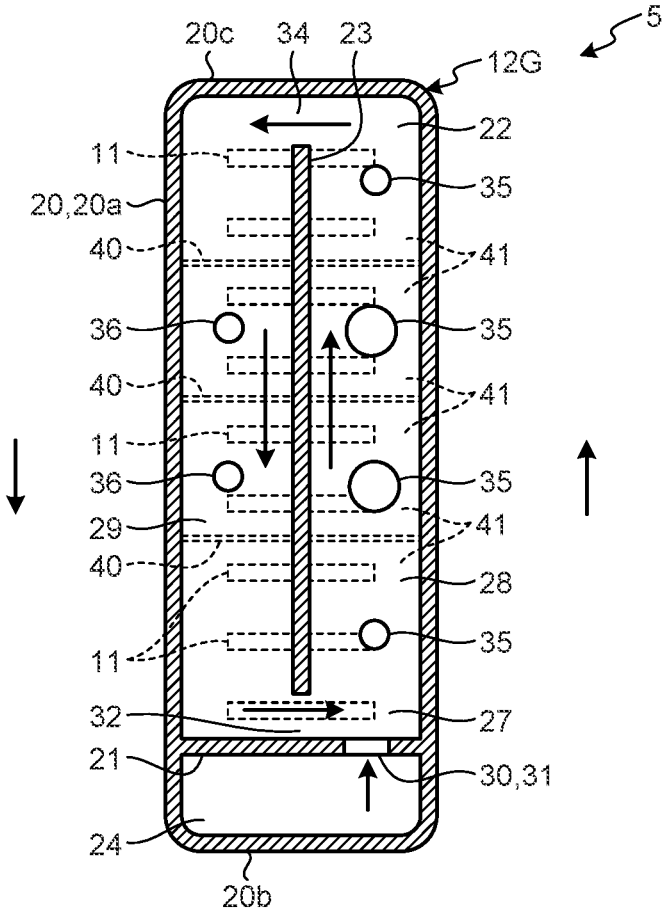
FIG. 13 is a vertical cross sectional view of a header of a heat exchanger according to a seventh embodiment.

FIG. 13 is a vertical cross sectional view of a header 12G of the heat exchanger 5 according to a seventh embodiment.

As illustrated in FIG. 13, the header 12G of the seventh embodiment is different from the header 12F of the sixth embodiment in that the number of the windward communication holes 35, the number of the leeward communication holes 36, and the number of the plurality of fourth partition members 40 are different with respect to the header 12F. Meanwhile, the seventh embodiment may be applied to embodiments other than the sixth embodiment.

In the seventh embodiment, the number of the windward communication holes 35 and the number of the leeward communication holes 36 are smaller than the number of the flat heat transfer tubes 11 that are connected to the connected portion 26. Further, the number of the windward communication holes 35 is larger than the number of the leeward communication holes 36. Furthermore, the plurality of fourth partition members 40 separate the connected portion 26 into a smaller number of portions than the number of the flat heat transfer tubes 11 that are connected to the connected portion 26. In the seventh embodiment, the plurality of fourth partition members 40 separate the connected portion 26 such that a plurality (as one example, two) of the flat heat transfer tubes 11 are connected to each of the stage portions 41.

With this configuration, as compared to a case in which the connected portion 26 is separated for the respective flat heat transfer tubes 11 that are connected to the connected portion 26, it is possible to simplify the configuration of the header 12G.

Thus, while the embodiments have been described above, the disclosed technology is not limited to the embodiments and may include various embodiments or the like that are not described herein. In addition, the embodiments may be combined.

REFERENCE SIGNS

5 heat exchanger
11 flat heat transfer tube
12 to 12D, 12F, 12G, 13 header
20 main body unit
21 first partition member
22 second partition member
23 third partition member
24 refrigerant inflow portion
25 upper portion
26 connected portion
27 opposite portion
28 windward portion
29 leeward portion
30 adjustment channel
31 windward inflow path
32, 34 communication path
33 leeward inflow path
35 windward communication holes
36 leeward communication holes
40 fourth partition member

The invention claimed is:

1. A heat exchanger comprising:

a plurality of flat heat transfer tubes that are laminated such that wide surfaces face one another; and a header that is connected to end portions of the plurality of flat heat transfer tubes, and that distributes a refrigerant to the plurality of flat heat transfer tubes, wherein the header includes a tubular main body unit;

a first partition member that separates an internal space of the main body unit into a refrigerant inflow portion into which the refrigerant flows and an upper portion that is located above the refrigerant inflow portion;

a second partition member that separates the upper portion into a connected portion that is connected to the plurality of flat heat transfer tubes and an opposite portion that is located opposite to the flat heat transfer tubes across the connected portion; and a third partition member that separates the opposite portion into a windward portion and a leeward portion that is located on a leeward side of an external air flow with respect to the windward portion, a plurality of windward communication holes and a plurality of leeward communication holes are arranged in the second partition member, the plurality of windward communication holes being aligned in a lamination direction of the plurality of flat heat transfer tubes and allowing communication between the windward portion and the connected portion, the plurality of leeward communication holes being aligned in the lamination direction of the plurality of flat heat transfer tubes and allowing communication between the leeward portion and the connected portion, an adjustment channel is arranged inside the header, the adjustment channel allowing the refrigerant that has flown into the refrigerant inflow portion to be distributed to the windward portion and the leeward portion, and increasing a flow rate of the plurality of windward communication holes as compared to a flow rate of the plurality of leeward communication holes, the adjustment channel includes a windward inflow path that is arranged in the first partition member, allows communication between the refrigerant inflow portion and the windward portion, and allows the refrigerant to flow from the refrigerant inflow portion, and a leeward inflow path that is arranged in the first partition member, allows communication between the refrigerant inflow portion and the leeward portion, and allows the refrigerant to flow from the refrigerant inflow portion, and a cross sectional area of the windward inflow path is larger than a cross sectional area of the leeward inflow path.

2. The heat exchanger according to claim 1, wherein the adjustment channel further includes a communication path that is arranged in an end portion of the third partition member in the lamination direction.

3. The heat exchanger according to claim 1, wherein the windward communication holes and the leeward communication holes are arranged for the plurality of flat heat transfer tubes that are connected to the connected portion, respectively.

4. The heat exchanger according to claim 3, wherein the header includes a plurality of fourth partition members that separate the connected portion for the plurality of flat heat transfer tubes that are connected to the connected portion.

5. The heat exchanger according to claim 1, wherein the plurality of windward communication holes have different cross sectional areas, and the plurality of leeward communication holes have different cross sectional areas.

6. The heat exchanger, according to claim 1, wherein the adjustment channel includes the plurality of windward communication holes and the plurality of leeward communication holes, and a total cross sectional area of the plurality of windward communication holes is larger than a total cross sectional area of the plurality of leeward communication holes.

7. The heat exchanger according to claim 1, wherein the adjustment channel includes the windward portion and the leeward portion, and a cross sectional area of the windward portion in a horizontal direction is larger than a cross sectional area of the leeward portion in the horizontal direction.

8. A heat exchanger comprising:

a plurality of flat heat transfer tubes that are laminated such that wide surfaces face one another; and a header that is connected to end portions of the plurality of flat heat transfer tubes, and that distributes a refrigerant to the plurality of flat heat transfer tubes, wherein the header includes a tubular main body unit;

a first partition member that separates an internal space of the main body unit into a refrigerant inflow portion into which the refrigerant flows and an upper portion that is located above the refrigerant inflow portion;

a second partition member that separates the upper portion into a connected portion that is connected to the plurality of flat heat transfer tubes and an opposite portion that is located opposite to the flat heat transfer tubes across the connected portion; and a third partition member that separates the opposite portion into a windward portion and a leeward portion that is located on a leeward side of an external air flow with respect to the windward portion, a plurality of windward communication holes and a plurality of leeward communication holes are arranged in the second partition member, the plurality of windward communication holes being aligned in a lamination direction of the plurality of flat heat transfer tubes and allowing communication between the windward portion and the connected portion, the plurality of leeward communication holes being aligned in the lamination direction of the plurality of flat heat transfer tubes and allowing communication between the leeward portion and the connected portion, an adjustment channel is arranged inside the header, the adjustment channel allowing the refrigerant that has flown into the refrigerant inflow portion to be distributed to the windward portion and the leeward portion, and increasing a flow rate of the plurality of windward communication holes as compared to a flow rate of the plurality of leeward communication holes, and an opening area of an uppermost windward communication hole of the plurality of windward communication holes is larger than an opening area of a lowermost windward communication hole of the plurality of windward communication holes.

* * * * *